US007302760B2

(12) United States Patent
Lake

(10) Patent No.: US 7,302,760 B2
(45) Date of Patent: Dec. 4, 2007

(54) FOLDING KNIFE WITH DUAL-ACTION PISTON

(75) Inventor: Ronald W. Lake, Eugene, OR (US)

(73) Assignee: Fiskar Brands, Inc., Madison, WI (US)

( * ) Notice: Subject to any disclaimer, the term of this patent is extended or adjusted under 35 U.S.C. 154(b) by 14 days.

(21) Appl. No.: 11/030,856

(22) Filed: Jan. 5, 2005

(65) Prior Publication Data

US 2005/0144788 A1 Jul. 7, 2005

Related U.S. Application Data

(60) Provisional application No. 60/534,017, filed on Jan. 5, 2004.

(51) Int. Cl.
*B26B 1/04* (2006.01)

(52) U.S. Cl. ..... 30/161; 30/159; 30/160

(58) Field of Classification Search ..... 30/160–161, 30/342, 337, 338
See application file for complete search history.

(56) References Cited

U.S. PATENT DOCUMENTS

| | | | | |
|---|---|---|---|---|
| 1,454,665 | A | 5/1923 | Bobek | |
| 1,743,022 | A | 1/1930 | Carman | |
| 2,530,236 | A * | 11/1950 | Erickson | 30/159 |
| 3,942,249 | A * | 3/1976 | Poehlmann | 30/161 |
| 4,040,081 | A | 8/1977 | Ninomiya et al. | |
| 4,173,068 | A | 11/1979 | Cargill | |
| 4,404,748 | A | 9/1983 | Wiethoff | |
| 4,451,982 | A | 6/1984 | Collins | |
| 4,502,221 | A | 3/1985 | Pittman | |
| 4,719,700 | A | 1/1988 | Taylor, Jr. | |
| 4,805,303 | A | 2/1989 | Gibbs | |
| 4,811,486 | A | 3/1989 | Cunningham | |
| 4,837,932 | A | 6/1989 | Elsener | |
| 4,893,409 | A | 1/1990 | Poehlmann | |
| 4,974,323 | A | 12/1990 | Cassady | |
| 4,979,301 | A | 12/1990 | Walker | |
| 5,044,079 | A | 9/1991 | Gibbs | |
| 5,060,379 | A | 10/1991 | Neely | |
| 5,095,624 | A | 3/1992 | Ennis | |
| 5,111,581 | A | 5/1992 | Collins | |
| 5,293,690 | A | 3/1994 | Cassady | |
| D348,599 | S | 7/1994 | Sakai | |
| 5,325,588 | A | 7/1994 | Rogers | |
| 5,331,741 | A | 7/1994 | Taylor, Jr. | |
| 5,425,175 | A | 6/1995 | Rogers | |

(Continued)

*Primary Examiner*—Boyer D. Ashley
*Assistant Examiner*—Laura M. Lee
(74) *Attorney, Agent, or Firm*—Kolisch Hartwell, P.C.

(57) ABSTRACT

A folding knife having a handle including a first side and a second side spaced apart to define a cavity; a blade including a cutting surface and a tang; and a holding mechanism including a piston adapted to be manually moved and having a first stop element of a first dimension and a first opposing element of a second dimension greater than the first dimension, at least a second stop element fixed on the tang, and at least a second opposing element also fixed on the tang, the first opposing element being adapted to be moved to a hold position when the blade is in one of the closed and open positions, in which the first opposing element seats against the second opposing element, the first stop element substantially engages the second stop element, and the blade is held in the one position.

21 Claims, 5 Drawing Sheets

U.S. PATENT DOCUMENTS 5,502,895 A 4/1996 Lemaire
5,515,610 A 5/1996 Levin et al.
5,537,750 A 7/1996 Seber et al.
5,546,662 A 8/1996 Seber et al.
D373,296 S 9/1996 Thompson
5,596,808 A 1/1997 Lake et al.
5,615,484 A 4/1997 Pittman
5,685,079 A 11/1997 Brothers et al.
5,689,885 A 11/1997 Walston
5,692,304 A 12/1997 Campbell
5,722,168 A * 3/1998 Huang ..... 30/161
5,737,841 A 4/1998 McHenry et al.
5,755,035 A 5/1998 Weatherly
5,802,722 A 9/1998 Maxey et al.
5,819,414 A * 10/1998 Marifone ..... 30/160
5,822,866 A 10/1998 Pardue
5,826,340 A 10/1998 Hull
5,887,347 A 3/1999 Gibbs
5,964,035 A * 10/1999 Poehlmann ..... 30/161
5,964,036 A 10/1999 Centofante
5,979,065 A * 11/1999 Hsu ..... 30/519
6,079,106 A 6/2000 Vallotton
6,154,965 A 12/2000 Sakai
6,256,887 B1 * 7/2001 Osborne ..... 30/161
6,338,431 B1 1/2002 Onion
6,378,214 B1 4/2002 Onion
6,397,477 B1 * 6/2002 Collins ..... 30/161
6,427,335 B1 8/2002 Ralph
6,438,848 B1 8/2002 McHenry et al.
6,490,797 B1 12/2002 Lake et al.
6,591,504 B2 7/2003 Onion
6,684,510 B1 * 2/2004 Collins ..... 30/161
6,751,868 B2 6/2004 Glesser
6,941,661 B2 * 9/2005 Frazer ..... 30/160
2004/0158991 A1 * 8/2004 Freeman ..... 30/161
2005/0097754 A1 * 5/2005 Onion ..... 30/159

* cited by examiner 10
12
14
16
18
22
24
26
28
30
30a
30b
30c
30d
30e
32
34
36
38
40
42
44
46
48
50
52
54
56
28c
A
P

FOLDING KNIFE WITH DUAL-ACTION PISTON

CROSS-REFERENCE TO RELATED APPLICATIONS

This application claims priority under 35 U.S.C. § 119(e) to U.S. Provisional Patent Application Ser. No. 60/534,017 entitled "Folding Knife With Piston Lock," filed Jan. 5, 2004, the entire disclosure of which is herein incorporated by reference for all purposes.

BACKGROUND

Pocket knives are commonly used by sportsmen, craftsmen and others who desire a compact, portable blade or tool. Folding knives commonly include a handle with two sides spaced apart to define a cavity, and a blade. The blade includes a cutting surface and a tang pivotally attached to the handle. The blade pivots with respect to the handle between an open position, where the cutting surface extends outwardly from the handle, and a closed position, where the cutting surface is disposed within the cavity of the handle.

Many folding knives also include a device that holds, maintains, or locks the blade in the open position and/or the closed position. One type of knife locking mechanism is a "liner lock," which utilizes a leaf spring positioned within the cavity of the knife handle and which engages the heel end of the knife blade. The blade is typically released by the user by applying finger pressure to the leaf spring, thus releasing the leaf spring from the knife blade. Another commonly used folding knife locking mechanism is a "back lock," which utilizes a locking bar positioned along an upper edge of the knife handle. When finger pressure is applied to the locking bar, a tang interconnected to the locking bar is withdrawn from a cut-out "anvil" portion which is positioned proximate the heel-end of the blade. When the tang is released, the knife blade is allowed to rotate between a first extended position of use and a second closed position wherein at least a portion of the knife blade is stored within a cavity in the knife handle.

Examples of folding knives, including folding knives with locking mechanisms, may be found in U.S. Pat. Nos. 1,454,665; 1,743,022; 4,040,081; 4,173,068; 4,404,748; 4,451,982; 4,502,221; 4,719,700; 4,805,303; 4,811,486; 4,837,932; 4,893,409; 4,974,323; 4,979,301; 5,044,079; 5,060,379; 5,095,624; 5,111,581; 5,293,690; 5,325,588; 5,331,741; 5,425,175; 5,502,895; 5,515,610; 5,537,750; 5,546,662; 5,596,808; 5,615,484; 5,685,079; 5,689,885; 5,692,304; 5,737,841; 5,755,035; 5,802,722; 5,822,866; 5,826,340; 5,887,347; 5,964,036; 6,079,106; 6,154,965; 6,338,431; 6,378,214; 6,427,335; 6,438,848; 6,490,797; 6,591,504; 6,751,868; D348,599, and D373,296, the entire disclosures of which are herein incorporated by reference for all purposes.

DETAILED DESCRIPTION

Figure 1:
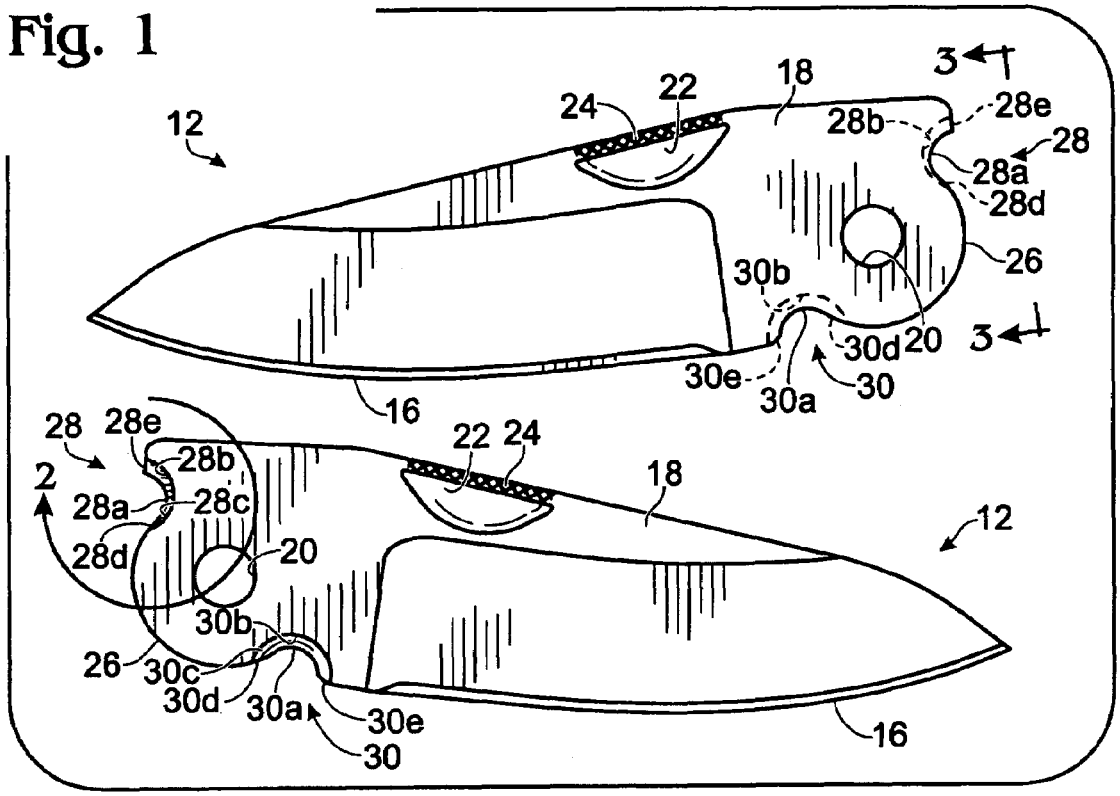
FIG. 1 is a side view of a first knife blade.
Figure 2:
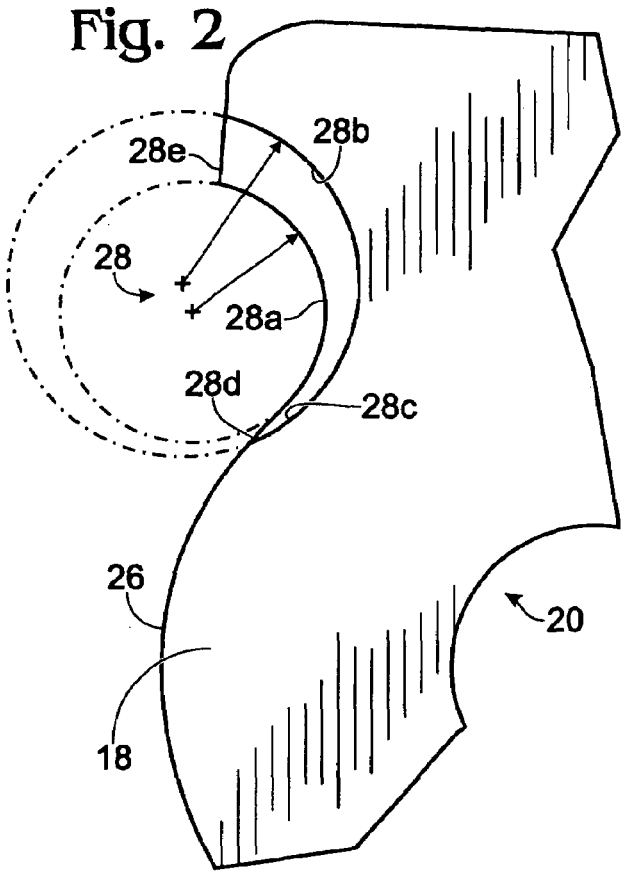
FIG. 2 is an enlarged view of section 2 shown in FIG. 1
Figure 3:
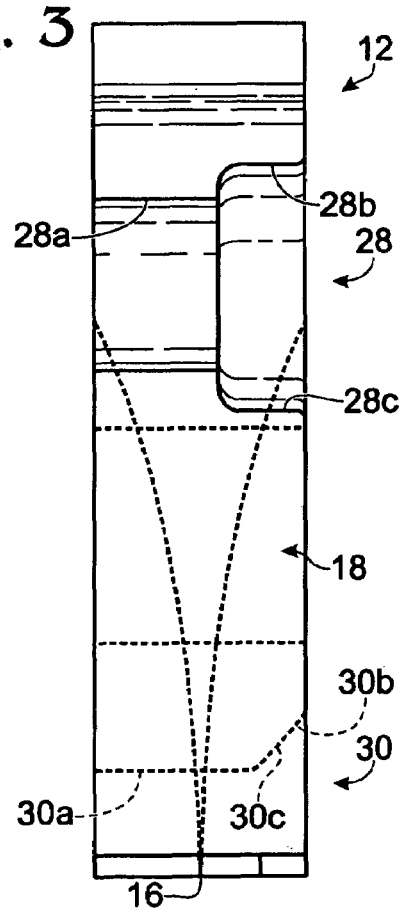
FIG. 3 is a rear view of the knife blade shown in FIG. 1.
Figure 4:
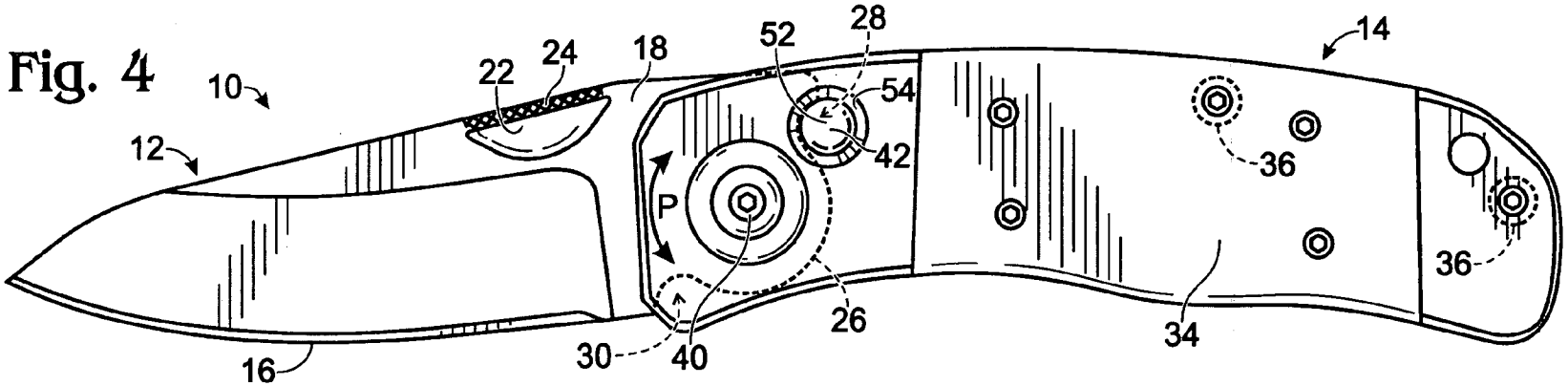
FIG. 4 is a side view of a folding knife depicting the blade of FIG. 1 locked in an open position.

Referring to FIGS. 1-10, a folding knife 10 is shown. Folding knife 10 may include a blade 12 and a handle 14. As shown in FIGS. 1 and 2, blade 12 may include a cutting edge 16, a tang 18, a bolt hole 20, and a thumb nick 22 with friction serrations 24 for creating friction between the blade and the thumb of a user. Tang 18 may include a lobe 26. Tang 18 may also include an indentation, such as an opening notch 28, for stopping and locking the blade in an open position, as discussed below. Tang 18 may include a closing notch 30, for facilitating closure of the blade, and for stopping and holding the blade in a closed position, as discussed below.

As shown in FIGS. 1-3 and 5, opening notch 28 may include a first notch portion 28*a*, and a second notch portion 28*b*. First notch portion 28*a* may also be referred to as a stop element because it forms a stop surface, as described below. The first and second notch portions may be separated by shoulder 28*c*, which may also be referred to as an opposing element because it has an opposing surface, as described below. The first and second notch portions may have different shapes and dimensions, as discussed below. In some examples, first notch portion 28*a* may be a circular cutout with a first diameter and second notch portion 28*b* may be a circular cutout with a second diameter that is larger than the first diameter. Optionally, the first and second notch portions may have the same or other diameters, or may be of other shapes configured as appropriate. The first notch portion 28*a* and second notch portion 28*b* may be configured with non-concentric centers offset with respect to one another. For example, the first notch portion 28*a* and second notch portion 28*b* may be eccentric, as shown in FIGS. 1 and 2. Further, the opening notch 28 may include a convergent end 28*d*, where the first notch portion 28*a* and second notch portion 28*b* at least slightly converge, and a divergent end 28*e*, where the first notch portion 28*a* and second notch portion 28*b* at least slightly diverge.

Closing notch 30 may include a first notch portion 30*a*, and a second notch portion 30*b*. First notch portion 30*a* may also be referred to as a stop element because it forms a stop surface, as described below. The first and second notch portions may be separated by a sloped face or edge 30*c*, which may also be referred to as an opposing element because it has an opposing surface, as described below. The first notch portion 30*a* and second notch portion 30*b* may have different shapes and dimensions, as discussed below. In some examples, first notch portion 30*a* may be a circular cutout with a first diameter, and second notch portion 30*b* may be a circular cutout with a second diameter that is larger than the first diameter. The first notch portion 30*a* and second notch portion 30*b* may be configured with non-concentric centers with respect to one other. For example, the first notch portion 30*a* and second notch portion 30*b* may be eccentric, as shown in FIG. 1. Further, the closing notch 30 may include a convergent end 30*d*, where the first notch portion 30*a* and second notch portion 30*b* converge, and a divergent end 30*e*, where the first notch portion 30*a* and second notch portion 30*b* diverge.

Figure 6:
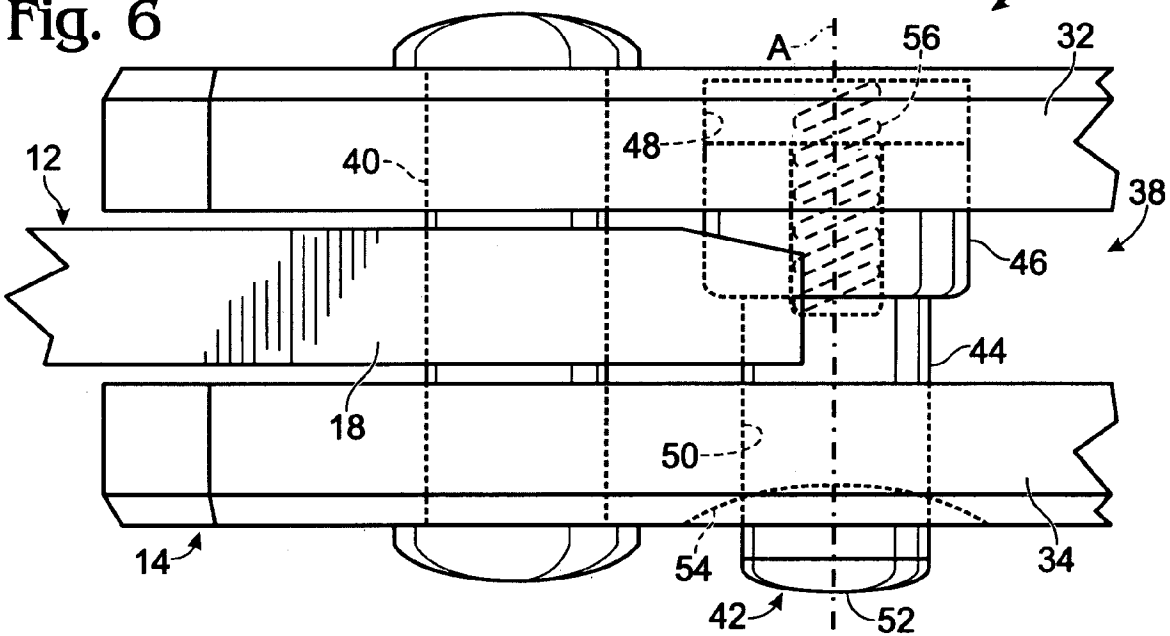
FIG. 6 is a top view of the folding knife shown in FIG. 3, depicting the blade locked in a fully open position.

As shown in FIGS. 4, 6, 8 and 10, handle 14 may include a first side 32 and a second side 34, which are spaced apart from, and are disposed parallel to each other. The first side and second side may be separated by spacer studs 36, by a handle spacer (not shown), or by any other suitable spacer. As best shown in FIG. 6, handle 14 defines a cavity 38 between the first and second sides of the handle for receiving the cutting edge 16 of the blade. Bolt hole 20 of tang 18 may be pivotally attached to the handle by pivot bolt 40, enabling the blade to pivot about pivot axis P between a fully open position and a fully closed position. In the fully open position, shown in FIGS. 4 and 6, the cutting surface extends outwardly from the handle. In the fully closed position, shown in FIGS. 8 and 10, the cutting surface is at least partially disposed within the cavity. Any position between a fully opened position and a fully closed position may be referred to as an intermediate position.

As shown in FIGS. 4, 6, 7, 8, and 10, folding knife 10 may include a movable piston 42 positioned to traverse cavity 38, and to interact with tang 18. Piston 42 may include a first portion or end 44 fixedly attached to a second portion or end 46. First end 44 may also be referred to as a stop element because it forms a stop surface, as described below. Second end 46 may also be referred to as an opposing element because it has an opposing surface, as described below. First end 44 and second end 46 may have different shapes and dimensions, as discussed below. For example, first end 44 may be cylindrical with a first diameter, and second end 46 may be cylindrical with a second diameter that is larger than the first diameter. The first and second ends may be configured to be concentric with respect to one another.

Figures 7, 8, 9, 10:
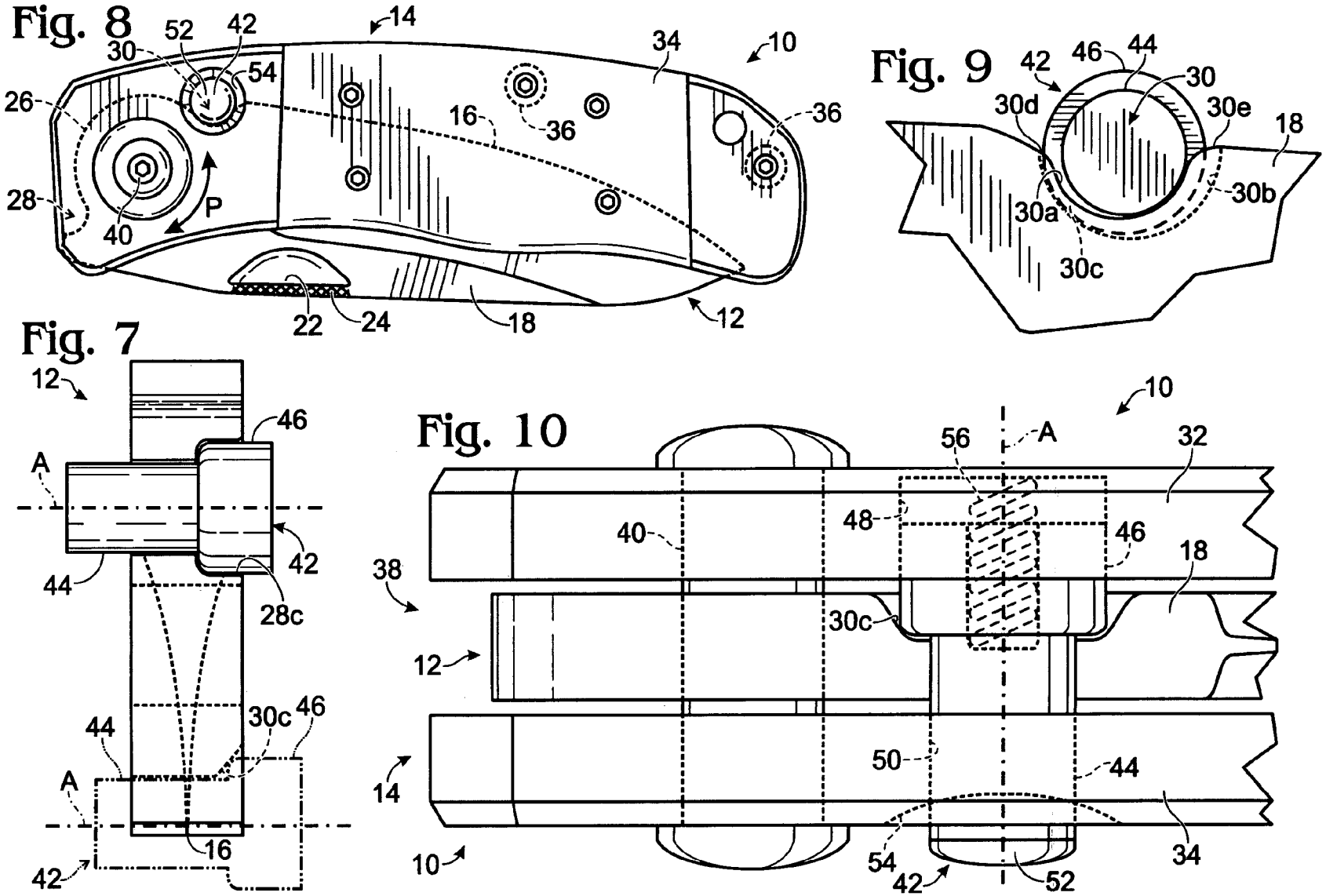
FIG. 7 is a rear view of the blade and piston of the folding knife shown in FIG. 3, depicting the position of the blade relative to the piston either when the blade is in the open position and the piston is in the lock position, or when the blade is in the closed position and the piston is in the closed position.
FIG. 8 is a side view of the folding knife shown in FIG. 3, depicting the blade in a closed position.
FIG. 9 is side view of the closing notch and the piston of the folding knife shown in FIG. 3, depicting the position of the first and second ends of the piston relative to the first and second notch portions of the closing notch when the blade is in the fully closed position.
FIG. 10 is a top view of the folding knife shown in FIG. 3, depicting the blade in a closed position.

As shown in FIGS. 6 and 10, second end 46 may be at least partially seated in a complementary groove 48 of first side 32 of the handle. First end 44 may be at least partially seated in a channel 50 of second side 34. First end 44 may fully traverse second side 34 to form an exposed button 52 within a recess 54. A biasing mechanism, such as spring 56, may bias piston 42 towards second side 34 along axis A until second end 46 makes contact with tang 18. Likewise, button 52 may be depressed manually within recess 54 along axis A, thereby causing spring 56 to compress until second end 46 is fully retracted (not shown) within groove 48. When second end 46 is fully retracted within groove 48, it may be unable to make contact with tang 18.

Figure 5:
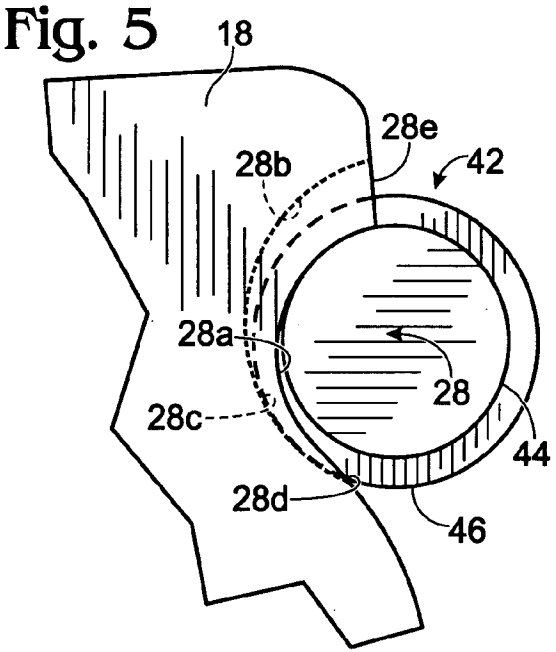
FIG. 5 is side view of the opening notch and the piston of the folding knife shown in FIG. 3, depicting the position of the first and second ends of the piston relative to the first and second notch portions of the opening notch when the blade is in the fully opened position.

Button 52 may provide a release mechanism, such that when button 52 is fully depressed, piston 42 is moved into a release position, wherein blade 12 is free to pivot about pivot axis P until it is stopped at a fully open position or a fully closed position. Specifically, as the blade is pivoted into a fully open position, as shown in FIG. 5, first end 44 may be adapted to stop the blade from pivoting past the fully open position by engaging the first notch portion 28*a*. First end 44 may have a complementary shape and size relative to first notch portion 28*a* that facilitates engagement. First end portion 44 and first notch portion 28*a* may therefore be referred to as stop elements because they have stop surfaces that engage each another to stop the blade from pivoting. For example, first notch portion 28*a* may be a circular cutout, and first end 44 may be a cylinder with a diameter equal to or slightly less than the diameter of first notch portion 28*a*. Piston 42 may be positioned relative to tang 18 such that first end 44 engages at least one location that may be near the divergent end 28*e* of first notch portion 28*a*.

Likewise, as the blade is pivoted into a fully closed position, as shown in FIG. 9, first end 44 may be adapted to stop the blade from pivoting past the fully closed position by engaging the first notch portion 30*a* of the opening notch 30. First end 44 may have a complementary shape and size relative to first notch portion 30*a* that facilitates engagement. First end 44 and first notch portion 30*a* may therefore be referred to as stop elements because they have stop surfaces that engage each other to stop the blade from pivoting. For example, first notch portion 30*a* may be a circular cutout, and first end 44 may be a cylinder with a diameter equal to or slightly less than the diameter of first notch portion 30*a*. Piston 42 may be positioned relative to tang 18 such that first end 44 engages first notch portion 30*a*.

When blade 12 is in a fully open position, piston 42 may be movable into a hold position, such as a lock position, that hinders or prevents the pivot of the blade towards the closed direction. As discussed above, when button 52 is depressed (not shown), the stop surfaces of the stopping elements prevent the blade from pivoting past the fully open position. However, the second end 46 is fully disposed within groove 48, thereby permitting the blade to pivot towards the closed position. When button 52 is not depressed, as shown in FIGS. 5-7, spring 56 may bias piston 42 along axis A towards second side 34. Second end 46 may be configured to have a complementary shape and size relative to second notch portion 28*b*, such that the biasing force of spring 56 urges second end 46 into opening notch 28 where it engages, and seats against, at least one point of shoulder 28*c*, which may be substantially near the convergent end 28*d*.

As shown in FIG. 5, the at least one point of engagement between second end 46 and shoulder 28*c* functions in opposition to the function of the stopping surfaces of the stopping elements. Second end 46 and shoulder 28*c* may therefore be referred to as opposing elements because they have surfaces that engage each other and function to oppose pivot of the blade away from a position in which the stop elements are engaged. The surfaces of the opposing elements may therefore be referred to as opposing surfaces. Further, the stop elements and opposing elements may function together to form a holding mechanism, which locks the blade in the fully open position. Configuring the stop elements and opposing elements to prevent pivot in either direction thereby prevents backlash between the blade and the handle when the knife is in the open position. More specifically, in this embodiment, second end 46 and shoulder 28*c* have opposing surfaces that engage when second end 46 is disposed within opening notch 28 in a lock position. As shown, second notch portion 28*b* may be a circular cutout, and second end 46 may be a cylinder with a diameter slightly less than the diameter of second notch portion 28*b*. Piston 42 may be positioned relative to tang 18 such that second end 46 engages the convergent end 28*d* of shoulder 28*c* when the stopping surfaces are engaged.

It should be appreciated that in some embodiments, first notch portion 28*a* and second notch portion 28*b* may be configured to be eccentric with respect to one another, while the first end 44 and second end 46 may be configured to be concentric with respect to one another. These relationships permit the first end 44 to engage the divergent end 28*e* of first notch portion 28*a* while simultaneously permitting second end 46 to engage the convergent end 28*d* of shoulder 28*c*. However, any suitable shape or configuration of the stop elements and opposing elements that permit first end 44 to engage first notch portion 28*a* while simultaneously permitting second end 46 to engage shoulder 28*c*, will prevent pivot of the blade in either direction.

It should also be appreciated that permitting second end 46 to engage a wider area of shoulder 28*c* may increase the frictional forces between the two opposing elements, thereby making it more difficult for a user to move piston 42 into a release position, or release position, by pressing button 52. Therefore, some embodiments may be configured to limit the area of engagement between second end 46 and shoulder 28*c* to a narrow region, such as a region substantially near the convergent end 28*d* of opening notch 28.

As discussed above, when button 52 is depressed (not shown), the stop surfaces of the stopping elements prevent the blade from pivoting past the fully closed position. However, the second end 46 is fully disposed within groove 48, thereby permitting the blade to pivot towards the closed position. When button 52 is not depressed, as shown in FIGS. 7 and 10, spring 56 biases piston 42 along axis A towards second side 34. Second end 46 may be configured to have a complementary shape and size relative to second notch portion 30*b*, such that the biasing force of spring 56 urges second end 46 into closing notch 30 where it engages, and seats against at least one point of sloped edge 30*c*, such as substantially near the convergent end 30*d*.

As shown in FIG. 9, the at least one point of engagement between second end 46 and sloped edge 30*c* may function in opposition to the function of the stop surfaces of the stopping elements. When second end 46 and sloped edge 30*c* are engaged, they provide a force on the blade towards the fully closed position until the stop elements engage and provide an opposing force. Second end 46 and sloped edge 30*c* may therefore be referred to as opposing elements with opposing surfaces that engage each other when second end 46 is disposed within closing notch 30 in a hold position. The stop elements and opposing elements function together to form a holding mechanism, which decreases the likelihood that the blade will inadvertently open. For example, in the embodiment shown, second notch portion 30*b* may be a circular cutout, and second end 46 may be a cylinder with a diameter slightly less than the diameter of second notch portion 30*b*. Piston 42 may be positioned relative to tang 18 such that second end 46 engages sloped edge 30*c* near the convergent end 30*d* when the stop surfaces are engaged.

In the embodiment shown in FIGS. 7 and 10, the closing mechanism loosely holds blade 12 in a closed position, such that a user may open blade 12 manually without depressing button 52. Specifically, the slope of sloped edge 30*c* prevents second end 46 from engaging closing notch 30 in a manner that firmly locks piston 42 in a fully closed position. If a user applies an opening force to blade 12, such as by pulling upward on thumb nick 27, second end 46 may frictionally slide up the slope of sloped edge 30*c*, thereby compressing spring 52, and disposing second end 46 increasingly within groove 48. When second end 46 reaches the top of the slope, it makes contact with lobe 26 of tang 18, and remains in contact with the lobe due to the biasing force of spring 52. Henceforth, second end 46 will remain in contact with lobe 26 of tang 18 until button 52 is depressed, or blade 12 is pivoted into either the fully open or fully closed position.

It should be appreciated that in some embodiments, first notch portion 30*a* and second notch portion 30*b* may be configured to be eccentric with respect to each other, while the first end 44 and second end 46 may be configured to be concentric with respect to one another. These convenient relationships facilitate manufacture and permit the first end 44 to engage at least the divergent end 30*e* of first notch portion 30*a* while simultaneously permitting second end 46 to engage the convergent end 30*d* of sloped edge 30*c*.

In the embodiment shown in FIGS. 1-10, when blade 12 is in an intermediate position (not shown) and button 52 is not depressed, second end 46 is biased by spring 52 to make contact with lobe 26 of tang 18. While the blade remains in an intermediate position, second end 46 remains biased by spring 52 to make contact with lobe 26. As the blade is pivoted from an intermediate position to the fully open position, spring 52 may bias the piston into the lock position as discussed above. Similarly, as the blade is pivoted from an intermediate position towards the fully closed position, spring 52 may bias second end 46 to slidably engage the slope of sloped edge 30*c* thereby pulling the blade into a fully closed position.

Figure 11:
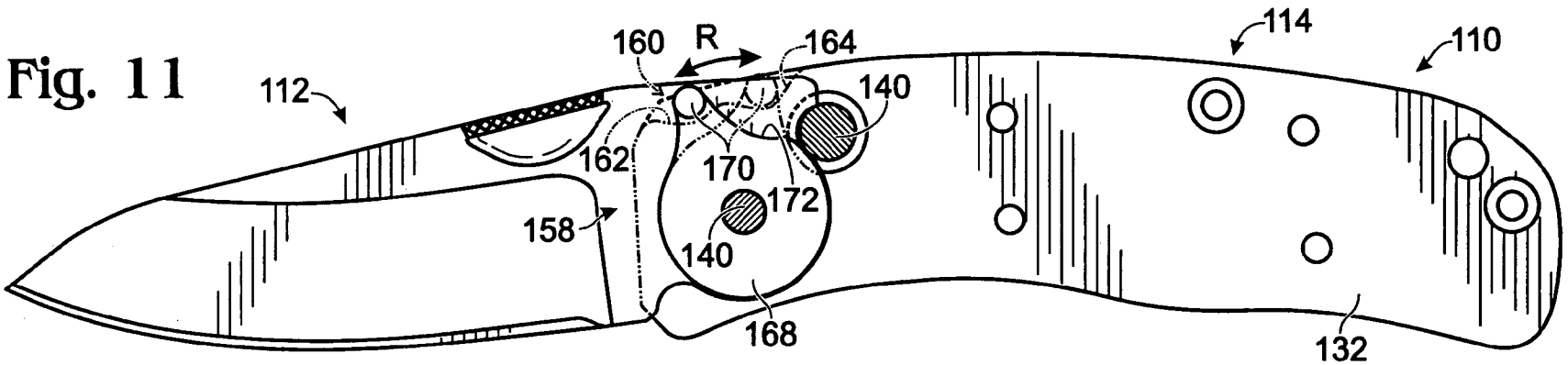
FIG. 11 is a side view of a second folding knife depicting the blade locked in the open position.
Figure 12:
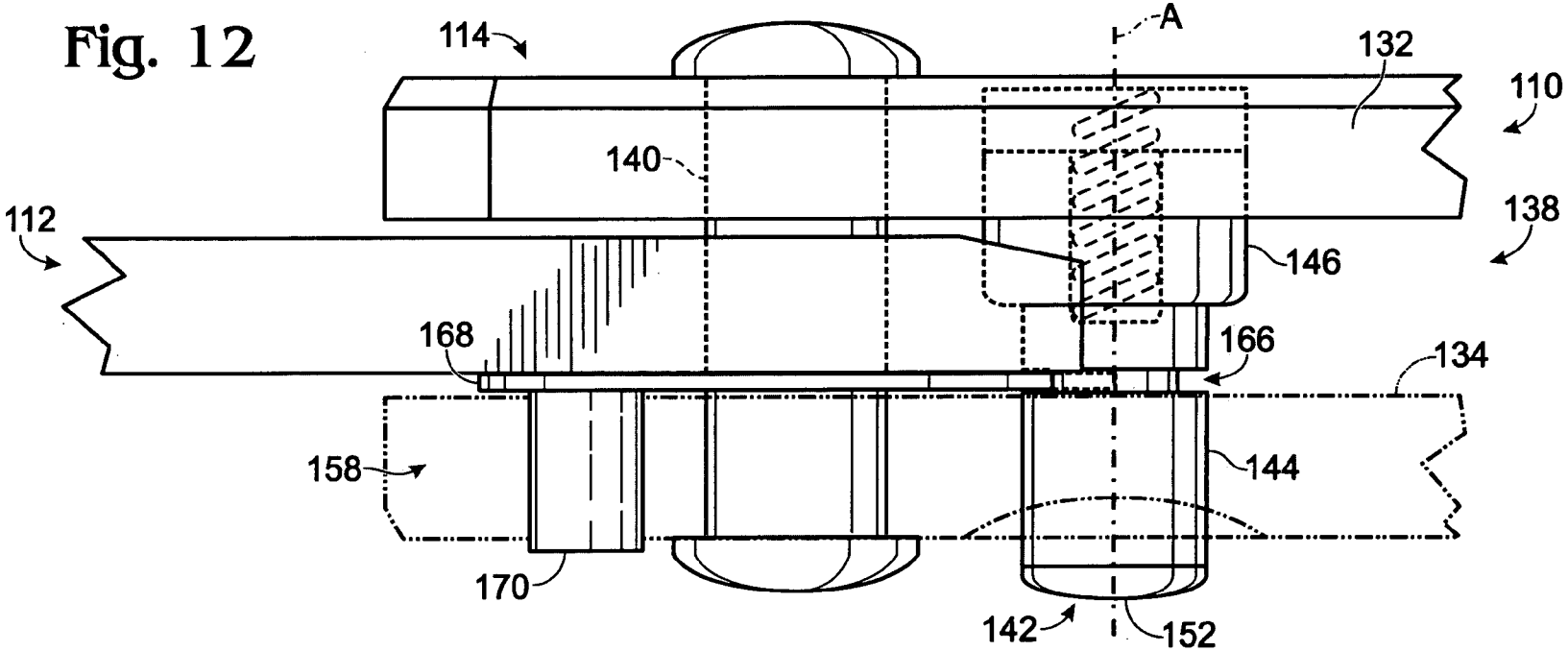
FIG. 12 is a top view of the folding knife shown in FIG. 11, depicting the blade locked in the open position.

Referring to FIGS. 11 and 12, a folding knife 110 is shown. Folding knife 110 includes blade 112, handle 114, pivot bolt 140, piston 142; and safety device 158. Blade 112 is substantially the same as blade 12, discussed above. Handle 114 is similar to handle 14, including first side 132 and second side 134, which are spaced apart to define cavity 138. However, handle 114 further includes a stud guide 160, including a first position 162 and a second position 164. Blade 112 is substantially the same as blade 12, and is pivotally attached to handle 114 by pivot bolt 140. Piston 142 is similar to piston 42, including first end 144, second end 146, and button 152. However, piston 142 further includes a safety groove 166 in first end 144. Safety device 158 may be adapted to selectively engage piston 142 to secure the piston in the lock position, thereby preventing a user from inadvertently disengaging the holding mechanism when using folding knife 110 in the fully open position.

In the embodiment shown in FIGS. 11 and 12, safety device 158 may include a safety washer 168 and a safety stud 170. Safety washer 168 may include a bolt hole (not shown), and a clearance notch 172. The safety device 158 may be rotatably attached to handle 114 by passing pivot bolt 140 through the safety washer bolt hole. When safety device 158 is attached, safety washer 168 may be positioned within cavity 138 between blade 112 and second side 134, and safety stud 170 may be positioned within stud guide 160.

Safety washer 168 may be rotatably positionable between a secured position and an unsecured position along rotational axis R. In the secured position, safety device 158 is rotated so that safety stud 170 is seated in first position 162 of stud guide 160, as shown in FIG. 11. Safety washer 168 may engage safety groove 166, thereby preventing a user from depressing button 152 and moving piston 142 axially, as shown in FIG. 9. In the unsecured position (not shown), safety device 158 is rotated so that safety stud 170 is seated in second position 164 of stud guide 160. Clearance notch 172 rotates into a position aligned with piston 142 that permits a user to depress button 152 and piston 142. It should be appreciated that safety device 158 may include any object adapted to movably engage piston 142 and secure it in the lock position.

Figure 14:
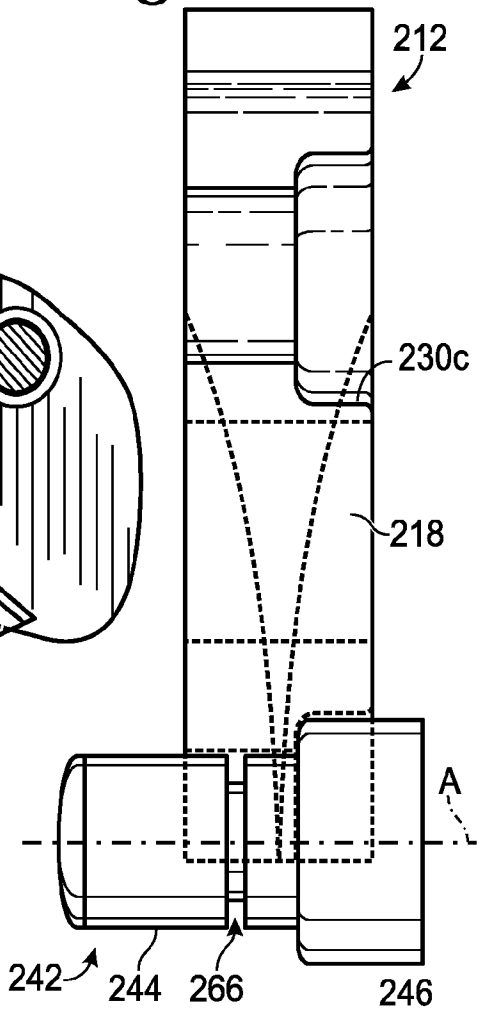
FIG. 14 is a rear view of the blade of the folding knife shown in FIG. 13.
Figure 13:
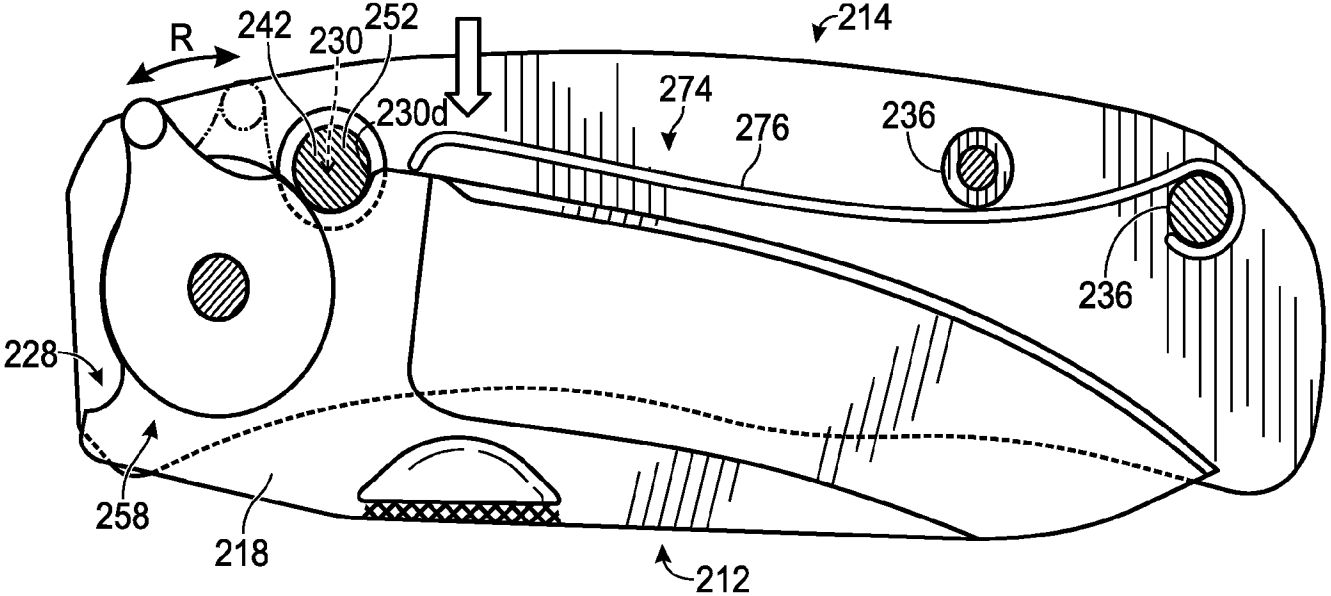
FIG. 13 is a side view of another folding knife depicting the knife locked in the closed position.

Referring to FIGS. 13 and 14, a folding knife 210 is shown. Folding knife 210 includes blade 212, handle 214, piston 242, safety device 258, and biasing element 274. Blade 212 is similar to blade 12, including a tang 218 with an opening notch 228 and a closing notch 230. However, closing notch 230 is different from closing notches 30 or 130. Specifically, closing notch 230 is substantially the same as opening notches 28 and 128 in that it includes an abrupt shoulder 230*c* instead of a sloped edge 30*c*. As with shoulder 28*c* discussed above, second end 246 may be moved into a lock position where it engages shoulder 230*c*, in this example, substantially near the convergent end 230*d* of closing notch 230 to lock blade 212 in a closed position.

In the embodiment shown in FIGS. 13 and 14, handle 214 is similar to handle 114, including a stud guide (not shown) with a first position and a second position. Piston 242 is similar to piston 142, including a button 252, and a safety grove 266 in first end 244. Safety device 258 is substantially the same as safety device 158 in that it is adapted to be moved along rotational axis R to a position engaging piston 242 to secure it in the lock position. Because piston 242 may be moved into the lock position when the blade is in either the open or closed positions, safety device 258 may thereby prevent a user from inadvertently disengaging the holding mechanism when blade 212 is in either the open or closed position.

As shown in FIG. 13, some embodiments may include a suitable biasing mechanism, such as biasing element 274, adapted to bias blade 212 from a closed position towards an open position. For example, biasing element 274 may include a wire spring 276 positioned within the blade cavity (not shown), and attached to spacer studs 236. Wire spring 276 may be configured to make contact with tang 218 when blade 212 is locked by piston 242 in the closed position. Disengaging the holding mechanism by pressing button 252 may cause wire spring 276 to urge blade 212 towards the open position in the manner of a switchblade mechanism. It should be appreciated that a user may only press button 252 to disengage the holding mechanism when safety device 258 is rotated into the unsecured position. Likewise, when safety device 258 is in the secured position, safety washer 268 may prevent a user from operating the switchblade mechanism by inadvertently pressing button 252.

The specific embodiments of knives as disclosed and illustrated herein are not to be considered in a limiting sense as numerous variations are possible. The subject matter of this disclosure includes all novel and non-obvious combinations and subcombinations of the various features, elements, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are different, broader, narrower or equal in scope to the original claims, are also regarded as included within the subject matter of the disclosure.

I claim:

1. A folding knife comprising:

a handle including a first side and a second side spaced apart to define a cavity;

a blade including a cutting surface and a tang, the tang being pivotally attached to the handle in a manner allowing the blade to pivot about a pivot axis between an open position with the cutting surface extending outwardly from the handle, and a closed position with the cutting surface disposed at least partially within the cavity; and a holding mechanism including a piston adapted to be manually moved along an axis substantially parallel to the pivot axis of the blade, the piston having a first stop element of a first dimension and a first opposing element of a second dimension greater than the first dimension, at least a second stop element fixed on the tang, and at least a second opposing element also fixed on the tang, the first opposing element being adapted to be moved to a hold position when the blade is in one of the closed or open positions, in which the first opposing element seats against the second opposing element, the first stop element substantially engages the second stop element, and the blade is held in the one position;

wherein the second stop element is a cutout having a stop surface and the second opposing element includes a cutout having an opposing surface, the stop surface and the opposing surface being curved eccentric surfaces relative to each other.

2. The folding knife of claim 1, wherein the holding mechanism includes a biasing mechanism that biases the first opposing element toward the second opposing element when the blade is in at least the one position.

3. The folding knife of claim 2, wherein the first opposing element is adapted to be manually disengaged from the second opposing element, to allow the blade to pivot between the open and closed positions.

4. The folding knife of claim 1, wherein the piston is generally cylindrical, the first stop element has a first diameter and the first opposing element has a second diameter larger than the first diameter.

5. The folding knife of claim 1, wherein the piston is adapted to be moved to a release position in which the first opposing element is disengaged from the second opposing element, and the blade is pivotable between the open and closed positions.

6. The folding knife of claim 5, wherein the holding mechanism includes a biasing mechanism that biases the first opposing element towards the hold position, and wherein the piston further includes a button adapted to be actuated manually to move the piston towards the release position when the button is actuated.

7. The folding knife of claim 6, wherein the piston, the stop surface and the opposing surface are adapted to prevent backlash between the blade and the handle when the blade is in the one position and the piston is in the hold position.

8. The folding knife of claim 6, further including a safety device adapted to prevent actuation of the button.

9. The folding knife of claim 8, wherein the piston includes a groove and the safety device includes a washer configured to engage selectively the groove when the piston is in the hold position.

10. The folding knife of claim 1, wherein, when the first opposing element seats against the second opposing element, the opposing surface applies a force on the blade toward the one position.

11. The folding knife of claim 10, wherein the opposing surface is at least partially sloped relative to the first opposing element when the first opposing element seats against the opposing surface of the second opposing element.

12. The folding knife of claim 10, wherein the holding mechanism includes a biasing mechanism that biases the first opposing element toward the second opposing element when the blade is in at least the one position.

13. The folding knife of claim 10, wherein the piston is generally cylindrical, the first stop element has a first diameter and the first opposing element has a second diameter larger than the first diameter.

14. The folding knife of claim 11, wherein the one position of the blade is the closed position, the knife further comprising a third stop element spaced from the second stop element and fixed relative to the tang, and a third opposing element also spaced from the second opposing element and fixed relative to the tang, the first opposing element being adapted to be moved to a lock position when the blade is in the open position, with the first opposing element seating against the third opposing element, the first stop element substantially engaging the third stop element, and the blade is locked in the open position.

15. The folding knife of claim 14, further comprising a biasing mechanism that biases the first opposing element toward the hold position when the blade is in the closed position, and toward the lock position when the blade is in the open position.

16. The folding knife of claim 15, wherein the first opposing element is adapted to be manually disengaged by exerting force on the blade from the hold position when the blade is in the closed position, and from the lock position when the blade is in the open position, to allow the blade to pivot between the open and closed positions.

17. The folding knife of claim 1, wherein the one position of the blade is the open position, the knife further comprising a third stop element spaced from the second stop element and fixed relative to the tang, and a third opposing element also spaced from the second opposing element and fixed relative to the tang, the first opposing element being adapted to be moved to a lock position when the blade is in the closed position, with the first opposing element seating against the third opposing element, the first stop element substantially engaging the third stop element, and the blade is locked in the closed position.

18. The folding knife of claim 17, further comprising a first biasing mechanism that biases the first opposing element toward the hold position when the blade is in the closed position, and toward the lock position when the blade is in the open position.

19. The folding knife of claim 18, wherein the first biasing mechanism includes a release mechanism adapted to disengage the first opposing element from the lock position and allow the blade to pivot when the release mechanism is actuated.

20. The folding knife of claim 19, further comprising a second biasing mechanism that biases the blade to pivot from the closed position toward the open position when the first opposing element is disengaged from the lock position.

21. The folding knife of claim 19, further including a safety device adapted to prevent actuation of the release mechanism.

* * * * *